US006240914B1

(12) United States Patent
Yasuga

(10) Patent No.: US 6,240,914 B1
(45) Date of Patent: Jun. 5, 2001

(54) TILE CUTTER

(75) Inventor: Masaki Yasuga, Osaka (JP)

(73) Assignee: Sankei Butusan, Co., Ltd., Osaka (JP)

( * ) Notice: Subject to any disclaimer, the term of this patent is extended or adjusted under 35 U.S.C. 154(b) by 0 days.

(21) Appl. No.: 09/413,352

(22) Filed: Oct. 6, 1999

(30) Foreign Application Priority Data

Aug. 5, 1999 (JP) ..... 11-221870

(51) Int. Cl.[7] ..... B26F 3/00
(52) U.S. Cl. ..... 125/23.02; 225/94; 225/96.5
(58) Field of Search ..... 225/96.5, 96, 94, 225/104; 125/23.01, 23.02; 33/626, 628, 630, 526, 527, DIG. 1, 806, 809; 83/522.19, 522.21

(56) References Cited

U.S. PATENT DOCUMENTS

| | | | | |
|---|---|---|---|---|
| 4,026,262 | * | 5/1977 | Yasuga | 225/96.5 |
| 4,653,194 | * | 3/1987 | Kim | 33/DIG. 1 |
| 5,169,045 | * | 12/1992 | Liu | 225/96.5 |
| 5,353,515 | * | 10/1994 | Alvis et al. | 33/626 |
| 5,373,835 | * | 12/1994 | Pourtau | 125/23.01 |
| 5,480,081 | * | 1/1996 | Wilson et al. | 225/96.5 |
| 5,480,082 | * | 1/1996 | Yasuga | 225/96.5 |
| 5,483,749 | * | 1/1996 | Hepworth | 125/23.02 |
| 5,505,359 | * | 4/1996 | Joecker, Jr. | 225/96.5 |
| 5,560,274 | * | 10/1996 | Turner | 125/23.02 |
| 5,615,665 | * | 4/1997 | Thiriet | 125/23.02 |
| 6,012,441 | * | 1/2000 | Liu | 225/96.5 |
| 6,053,159 | * | 4/2000 | Liu | 125/23.02 |

FOREIGN PATENT DOCUMENTS

| | | | | |
|---|---|---|---|---|
| 2716 085 | * | 10/1978 | (DE) | 125/23.02 |
| 2855 649 | * | 7/1980 | (DE) | 125/23.02 |
| 52-35592 | | 8/1977 | (JP) . | |
| 55-56008 | | 12/1980 | (JP) . | |

* cited by examiner

*Primary Examiner*—Rinaldi I. Rada
*Assistant Examiner*—Thomas J. Druan, Jr.
(74) *Attorney, Agent, or Firm*—Armstrong, Westerman, Hattori, McLeland & Naughton, LLP

(57) ABSTRACT

A tile cutter provided with a supporting rail of which cross section is inverted T having a straight supporting ridge portion in a longitudinal direction, a front fixation post having a tile contact portion in a direction at right angles with the supporting rail and attached to an end of the supporting rail, a rear fixation post attached to the other end of the supporting rail, a guide rail arranged on upper ends of the front and rear fixation posts and parallel to the supporting rail, a scale for measuring tile cutting dimension having a tile receiving plate of which upper face corresponds to a top portion of the supporting ridge portion and attached onto the supporting rail as to freely slide along the supporting rail, and a tile cutting operation unit attached to the guide rail as to freely slide along the guide rail.

6 Claims, 8 Drawing Sheets

TILE CUTTER

BACKGROUND OF THE INVENTION

1. Field of the Invention

This invention relates to a tile cutter.

2. Description of the Related Art

A conventional tile cutter, for example, as disclosed by Japanese utility model publication No. 52-35592 and No. 55-56008, has a construction in which fixation posts facing each other are formed uniformly with a base of large install area or attached and fixed to the base, a supporting rail is arranged on a line connecting the above fixation posts approximately on a central portion of the base, a tile placing face covered with a tile supporting elastic plate of which thickness is approximately same as height of the supporting rail is formed on the both sides of the supporting rail, a scale for measuring tile cutting dimension is arranged on the base around the tile placing face, a guide rail parallel to and just above the supporting rail is placed on the fixation posts facing each other, and a tile cutting operation unit provided with a cutter and a tile pressing leg protruding to both sides on a lower end portion of an operation lever is supported by the guide rail as to freely slide.

In this conventional tile cutter, however, the tile placing face covered with a tile supporting elastic plate is formed on the both sides of the supporting rail, when the tile pressing leg presses both sides of a cutting line which is drawn by the tile cutting operation unit, the pressing force is dispersed by resistance of the tile supporting elastic plate on the tile placing face and hardly concentrates on the cutting line. Therefore, accurate cutting on the cutting line and making a fine cutting face require skill. Especially, in cutting a thick tile, required degree of skill is high, cracks and chips tend to be generated at both ends of the cutting line etc., defective products are frequently generated thereby.

And, the tile cutter becomes of large width, weight, and volume for the base supporting the tile supporting elastic plate. Cost of making the tile cutter itself increases thereby. Cost is also increased by complicated packing, large amount of packing materials, and transportation of the tile cutter. Further, uneconomical storage and inconvenience of handling are caused on users' side.

Further, in a tile cutter for cutting a large-size tile, bases of which sizes correspond to that of tiles to be cut are required. This causes not only further heavy weight of the tile cutter, but need of making several kinds of bases corresponding to the sizes of the tiles. Uneconomical manufacturing of the tile cutter that increases the manufacturing cost of the tile cutter is caused thereby.

And, in forming triangle tiles by cutting a square tile on its diagonal line, the tile moves when the cutting line is drawn for difficult positioning of the tile, and skill is required to form fine triangle tiles by cutting the tile accurately on the diagonal line.

It is therefore an object of the present invention to provide a tile cutter easy to handle and manufactured with low cost with which skill is not required to cut a tile accurately on a diagonal line into rectangles and triangles.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
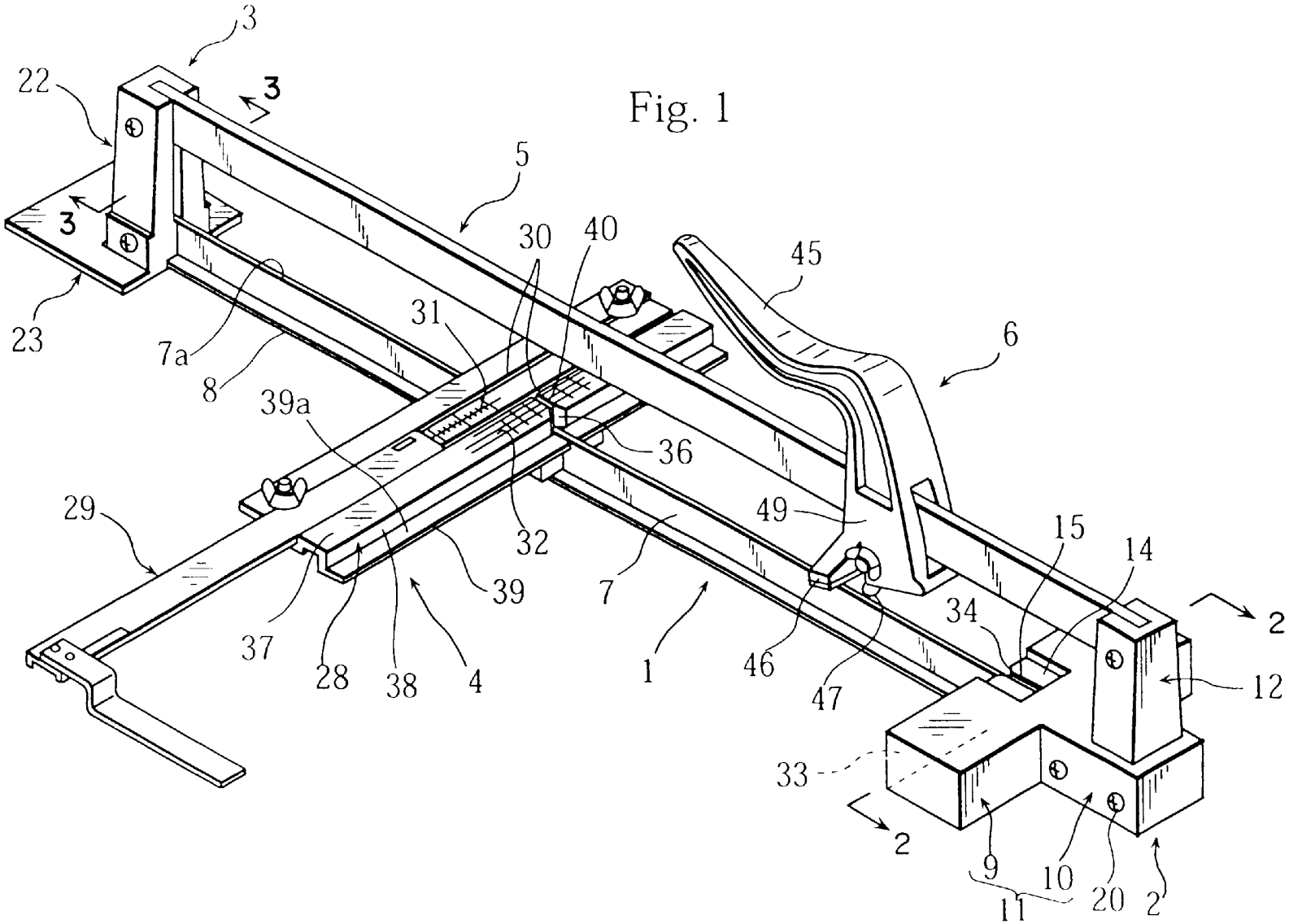
FIG. 1 is a perspective view showing a preferred embodiment of a tile cutter of the present invention.
Figure 2:
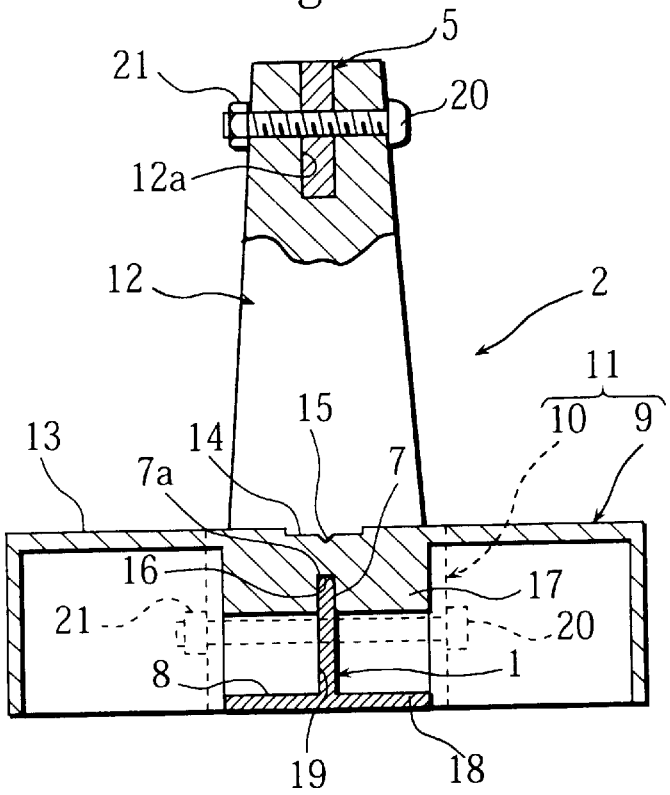
FIG. 2 is a cross-sectional view at an 2—2 line shown in FIG. 1.
Figure 3:
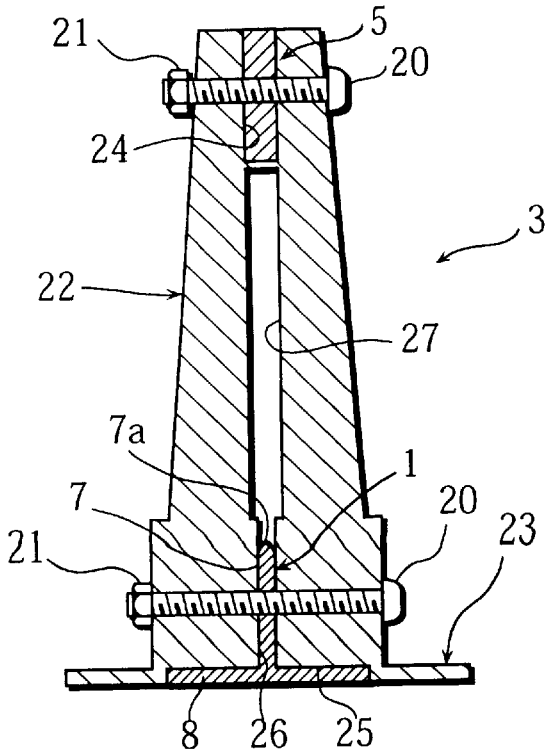
FIG. 3 is a cross-sectional view at a 3—3 line shown in FIG. 1.

FIG. 1 shows a preferred embodiment of a tile cutter of the present invention, FIG. 2 is a cross-sectional view at 2—2 line shown in FIG. 1, and FIG. 3 is a cross-sectional view at 3—3 line shown in FIG. 1. 1 is a supporting rail of which cross section is an inverted T, a front fixation post 2 is attached to an end of the supporting rail 1, and a rear fixation post 3 is attached to the other end of the supporting rail 1. And, 4 is a scale for measuring cutting dimension of a tile, which is arranged on the supporting rail 1 as to freely slide. And, a guide rail 5 is arranged on upper ends of the front fixation post 2 and rear fixation post 3 and parallel to the supporting rail 1, and a tile cutting operation unit 6 is arranged on the guide rail 5 as to freely slide. In the present invention, a longitudinal direction parallel to the supporting rail 1 is defined as a back-and-forth direction, and a direction at right angles with the supporting rail 1 is defined as a left-and-right direction.

To describe concretely, the supporting rail 1 is formed with steel of which cross section is an inverted T, a supporting ridge portion 7 of band plate having a rounded top portion 7a is arranged in a longitudinal direction of the supporting rail 1, and a flat board portion 8 is arranged along a lower end of the supporting ridge portion 7. And, the guide rail 5 is formed with steel as to have a rectangular cross section.

As shown in FIG. 1 and FIG. 2, the front fixation post 2 is composed of a base portion 11 of T-shaped in a top view having a tile contact portion 9 at right angles with the supporting rail 1 and a fixation portion 10 protruding forward from a middle portion of the tile contact portion 9, and a post portion 12 standing on an upper face of the fixation portion 10 of the base portion 11. And, the front fixation post 2 is uniformly die-cast with aluminum as a whole.

Concretely, the tile contact portion 9 of the base portion 11 has a rectangular-box shape with a downward opening, a notched concave portion 14 is formed on a rear face 33 side of an upper face 13 middle of the tile contact portion 9, and a V-groove 15 in the back-and-forth direction is formed on a middle portion of a bottom face of the notched concave portion 14. And, a thick wall portion 17 is formed on an inner side of an upper wall of the tile contact portion 9, and a concave groove 16 opening downward for insertion of the supporting ridge portion 7 of the supporting rail 1 is formed on a position of the thick wall portion 17 corresponding to the above V-groove 15 in the back-and-forth direction.

Figure 6:
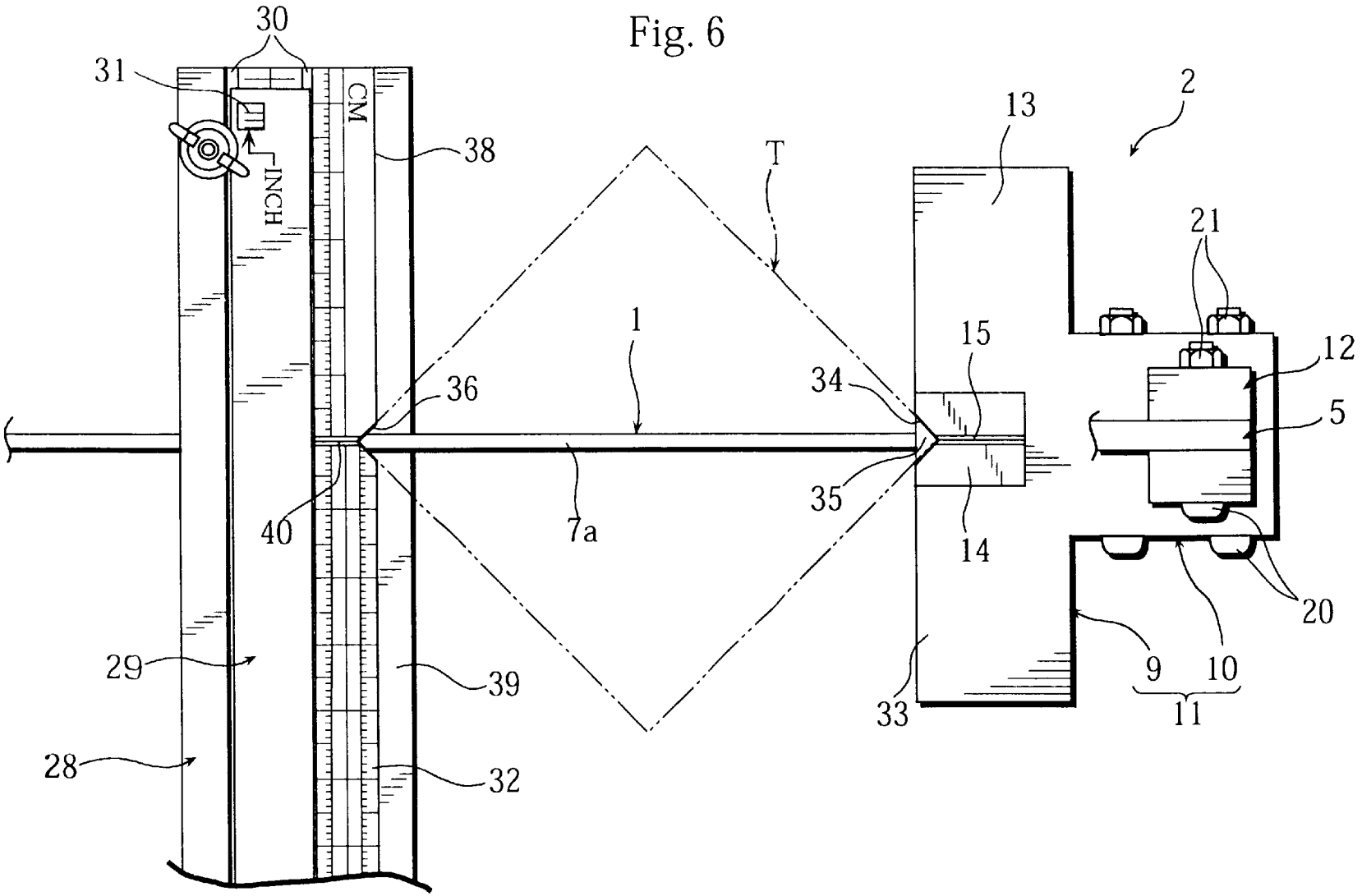
FIG. 6 is an explanatory view showing a set state of a tile cut into triangles.

Then, as shown in FIG. 1 and FIG. 6, a notch 34 for tile positioning approximately V-shaped with a right angle is notched vertically on a position of the above V-groove 15 on the rear face 33 of the tile contact portion 9 (a position right above the supporting rail 1) as to leave a stepped portion 35. That is to say, when a square tile T is cut on a diagonal line into triangles, a corner of the tile T contacts the notch 34 for tile positioning on the tile contact portion 9 side and another corner of the tile T contacts a (later-described) notch 36 for tile positioning on the scale 4 side, and the tile T is fixed thereby.

And, the fixation portion 10 of the base portion 11 has a rectangular-block shape, a shallow concave portion 18 opening downward is formed on a lower portion of the fixation portion 10 for insertion of the flat board portion 8 of the supporting rail 1, and a concave groove 19 connected to the concave portion 18 is formed in the back-and-forth direction in the middle of the fixation portion 10. Then, the supporting ridge portion 7 on an end side of the supporting rail 1 is inserted to the concave groove 19 of the fixation portion 10 and the concave groove 16 of the tile contact portion 9, bolts 20 are inserted to hole portions disposed on the fixation portion 10 and the supporting ridge portion 7 and fastened with nuts 21, and the supporting ridge portion 7 is attached by both wall portions of the concave groove 19 which press and hold the supporting ridge portion 7. And, width dimension of the concave groove 19 and the concave groove 16 are approximately same as the thickness dimension of the supporting ridge portion 7.

And, a notched groove 12*a* opening backward is formed on an upper end of the post portion 12. An end of the guide rail 5 is inserted to the notched groove 12*a,* bolts 20 are inserted to hole portions disposed on the post portion 12 and the guide rail 5 and fastened with nuts 21, and the guide rail 5 is attached by both wall portions of the notched groove 12*a* which press and hold the guide rail 5.

As shown in FIG. 1 and FIG. 3, the rear fixation post 3 is composed of a post portion 22 and a footboard portion 23 arranged at a lower end of the post portion 22 as to correspond to a bottom face of the post portion 22, and the rear fixation post 3 is die-cast with aluminum as a whole. And, a notched groove 24 opening forward is formed on an upper end of the post portion 22, and, a concave portion 25 opening downward and a concave groove 26 opening forward (of small width dimension) connected to the concave portion 25 are formed on a lower end of the post portion 22. And, 27 is a concave groove formed to lighten the post.

Then, the supporting ridge portion 7 and the flat board portion 8 on another end side of the supporting rail 1 are inserted to the concave groove 26 and the concave portion 25 of the post portion 22, bolts 20 are inserted to hole portions disposed on a lower portion of the post portion 22 and the supporting ridge portion 7 and fastened with nuts 21, and the supporting ridge portion 7 is pressed and held by both wall portions of the concave groove 26. And, another end of the guide rail 5 is inserted to the notched groove 24, bolts 20 are inserted to hole portions disposed on an upper portion of the post portion 22 and the guide rail 5 and fastened with nuts 21, and the guide rail 5 is pressed and held by both wall portions of the notched groove 24.

Figure 4:
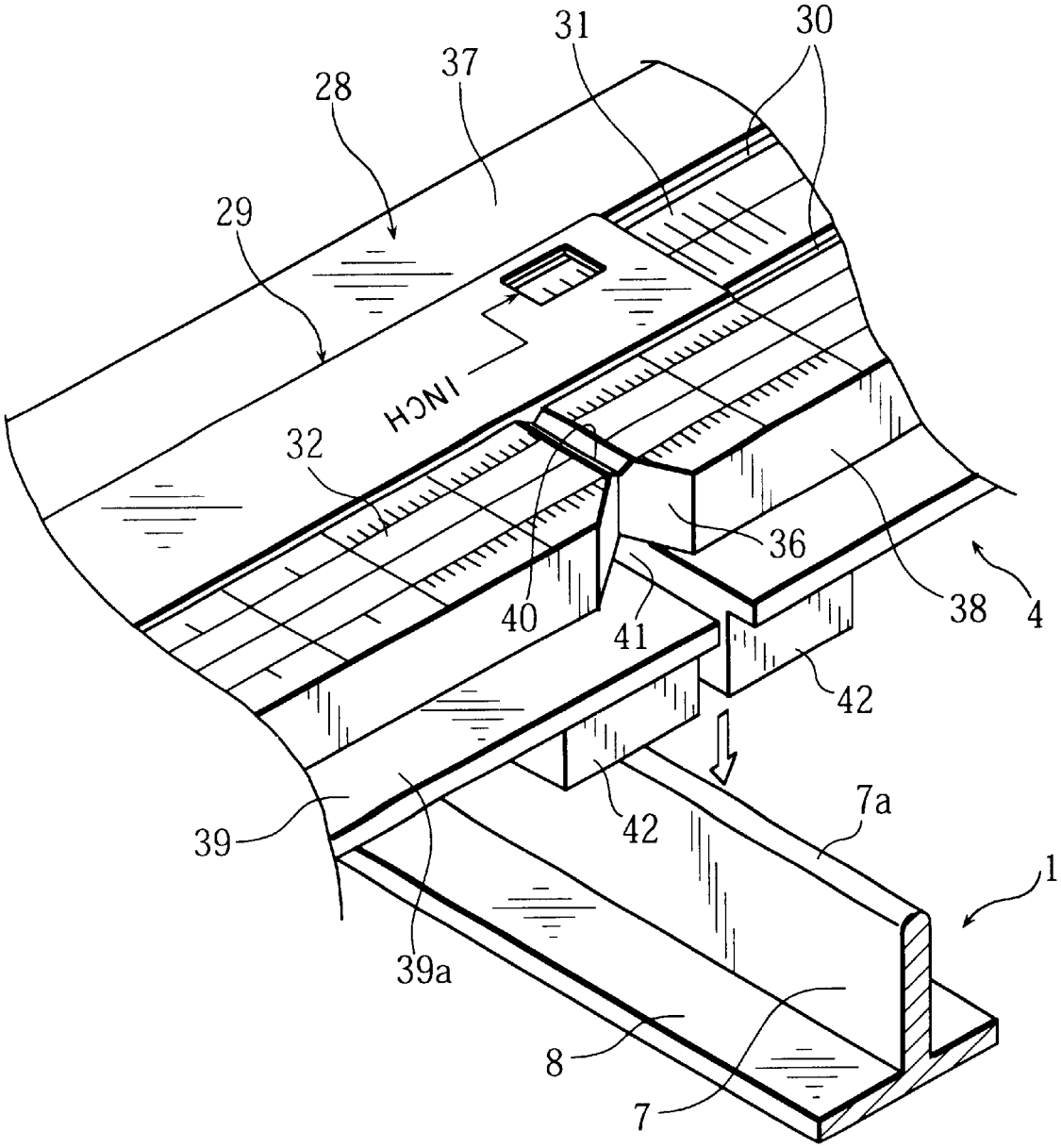
FIG. 4 is a perspective view of enlarged principal portion showing a state of a scale before attached to a supporting rail.
Figure 5:
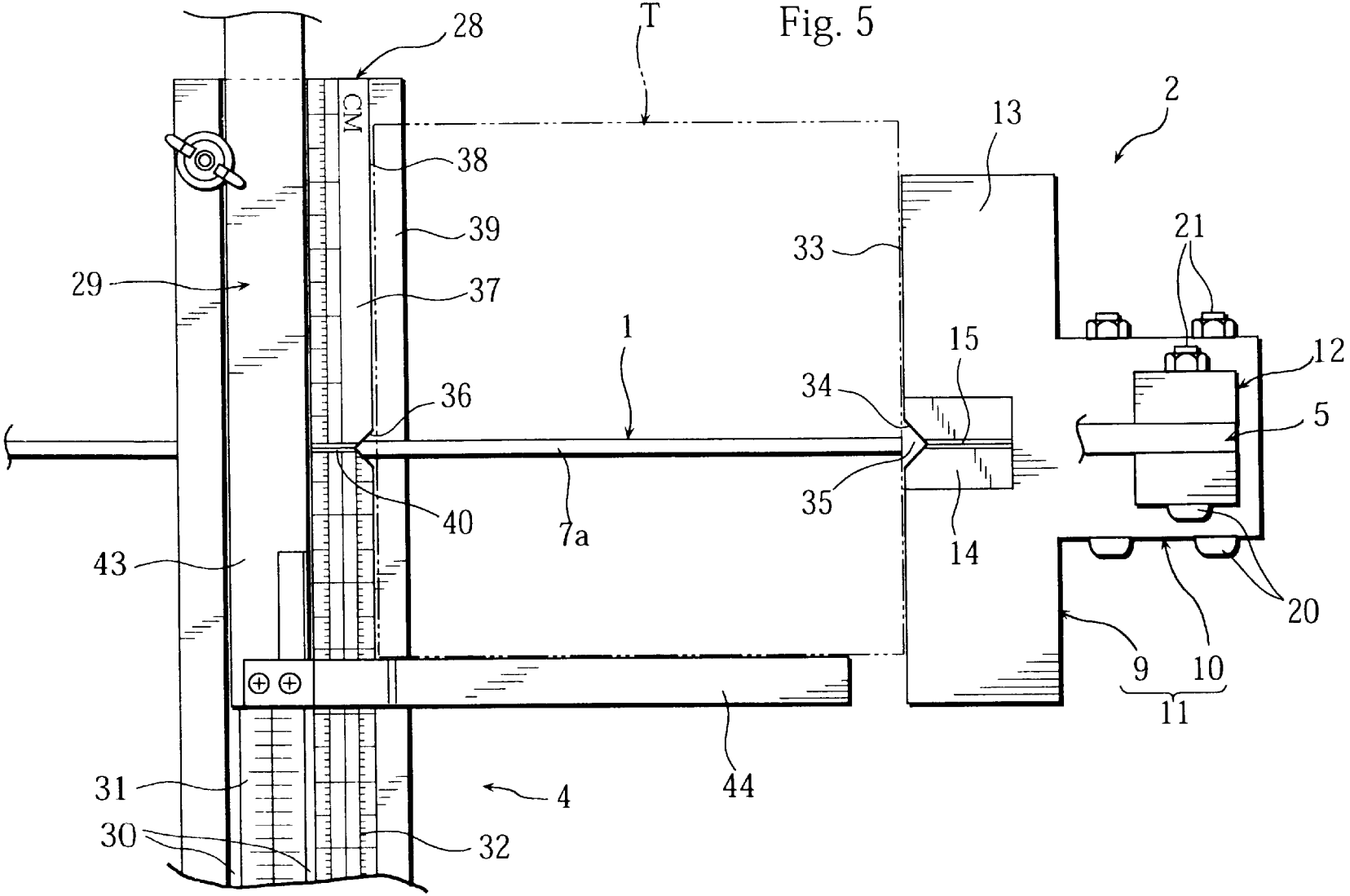
FIG. 5 is an explanatory view showing a set state of a tile.

Next, as shown in FIGS. 1, 4, and 5, the scale 4 is provided with a scale main body 28 (made of aluminum, for example) detachably attached to the supporting rail 1 in a direction at right angles with the supporting rail 1 (the left-and-right direction) and a L-shaped sliding scale 29 attached along one pair of guide grooves 30 formed in the left-and-right direction on an upper face 37 of the scale main body 28 as to freely slide.

The scale main body 28 has a graduation 31 graduated in inches between the pair of guide grooves 30, and a graduation 32 graduated in centimeters in front of the graduation 31 in inches. And, a tile receiving plate 39 in the left-and-right direction is arranged on a lower position than the upper face 37 in front of the graduation 32 in centimeters through a stepped face portion 38.

Further, a V-groove 40 is formed in the back-and-forth direction on a base position (a position of 0 cm) on the graduation 32 in centimeters, and the (above-mentioned) notch 36 for tile positioning approximately V-shaped with a right angle is notched vertically on a position of the V-groove 40 of the above stepped face portion 38. That is to say, in a state in which the scale 4 is attached to the supporting rail 1, the notch 36 is disposed as to face the notch 34 of the front fixation post 2.

A slit in the back-and-forth direction is formed on a position corresponding to the above V-groove 40 on the tile receiving plate 39, and a pair of sliding blocks 42 forming a concave groove 41 in the back-and-forth direction with the slit continuously on a lower face of the scale main body. That is to say, the scale 4 is attached to the supporting rail 1 slidably and detachably by fitting the concave groove 41 to the supporting ridge portion 7 of the supporting rail 1. In this case, an upper face 39*a* of the tile receiving plate 39 corresponds to the top portion 7*a* of the supporting ridge portion 7 on the same plane, and the scale 4 is held horizontally by the sliding blocks 42 without trembling. And, width dimension of the concave groove 41 is approximately same as the thickness of the supporting ridge portion 7.

And, the sliding scale 29 of the scale 4, is composed of a gate-shaped slide portion 43 having a window portion for reading the graduation 31 in inches on each of the left side and the right side and slidably fitted to the guide grooves 30, and an arm portion 44 for tile-positioning and measuring attached to an end side of the slide portion 43 as to be at right angles with the slide portion 43. And, the sliding scale 29 is fixed to a desirable position with wing nuts and washers screwed on the scale main body 28.

Figure 7:
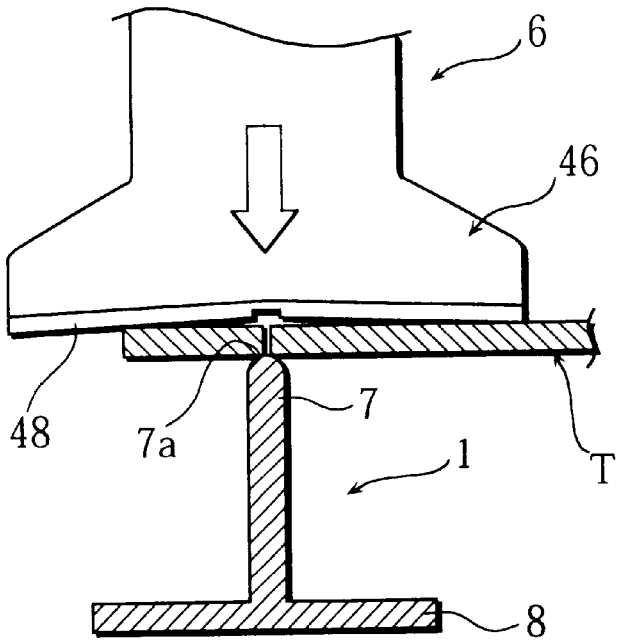
FIG. 7 is a working explanatory view showing a state in which a tile is pressed a cut at a cutting line.

As shown in FIG. 1 and FIG. 7, the tile cutting operation unit 6 has a sliding portion 49 having a through hole to which the guide rail 5 is inserted, an operation lever 45 above the sliding portion 49, and a tile pressing leg 46 and a circular cutting blade 47 on a lower portion of the sliding portion 49. A lower face of the tile pressing leg 46 which inclines slightly downward to the both sides is covered with an elastic sheet piece 48 made of rubber, etc.

Next, working of the tile cutter of the present invention is described. As shown in FIG. 1 and FIG. 5, in a case that a square tile T is cut into rectangles, the tile T is placed on the top portion 7*a* of the supporting ridge portion 7 of the supporting rail 1 and the upper face 39*a* of the tile receiving plate 39, and the scale 4 is slid forward as a front edge of the tile T contacts the rear face 33 of the tile contact portion 9 of the front fixation post 2. Then, the arm portion 44 of the sliding scale 29 is slid in the left-and-right direction to measure and fix the cutting dimension, and a side edge of the tile T contacts the arm portion 44 for positioning.

And, the footboard portion 23 of the rear fixation post 3 is stamped by a foot of an operator to fix the tile cutter, and the tile cutting operation unit 6 is moved forward from the rear side to the front side to form (press to cut) a cutting line on the surface (upper face) of the tile T with the circular cutting blade 47. In this case, edge of the circular cutting blade 47 is not damaged for clearance of the V-groove 40 on the scale 4 side and the V-groove 15 on the tile contact portion 9 side, and the cutting line is formed thoroughly for a space formed with the notch 36 on the scale 4 side and the tile T and a space formed with the notch 34 on the tile contact portion 9 side and the tile T.

Then, as shown in FIG. 1 and FIG. 7, the operation lever 45 is oscillated downward to press the both sides of the cutting line on the tile T with the pressing leg 46, rear edge of the tile T on the tile receiving piece 39 side slightly raises, reaction force from the supporting ridge portion 7 concentrates on the cutting line, and the tile T is cut (pressed to part) accurately on the cutting line. That is to say, the tile T is cut with fine cutting faces without cracks running out of the cutting line and chips because the tile T is pressed on three points, namely, the top portion 7*a* of the supporting ridge portion 7 corresponding to the cutting line, and two points, each of which is on the right side and the left side of the cutting line respectively, where the tile pressing leg 46 presses the tile T. In this case, as shown in FIG. 7, accurate cut on the cutting line (fine cutting face) is realized even with a small width W.

Next, in a case that the square tile T is cut into triangles, as shown in FIG. 1 and FIG. 6, the tile T is pinched at its two corners facing each other by the notch 34 for tile positioning on the tile contact portion 9 side and the notch 36 for tile positioning on the scale 4 side. The tile T is held by the stepped portion 35 of the tile contact portion 9, the supporting rail 1, and the tile receiving plate 39 of the scale 4. And, a diagonal line, on which the tile T is cut, corresponds to the top portion 7*a* of the supporting ridge portion 7.

In this case, the footboard portion 23 of the rear fixation post 3 is stamped by a foot of an operator, the tile T is lightly held by a hand to be stable, the tile cutting operation unit 6 is pushed from the rear side to the front side as a cutting line is formed on the diagonal line on the surface (upper face) of the tile T with the circular cutting blade 47. Then, (as described with reference to FIG. 7) the tile pressing leg 46 presses the tile T on the both sides of the cutting line, and the tile T is cut into triangles of fine cutting faces without generating cracks and chips running out of the cutting line.

Figure 8:
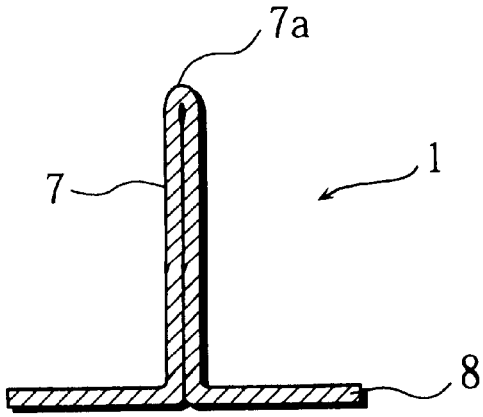
FIG. 8 is a cross-sectional view showing another supporting rail.
Figure 9:
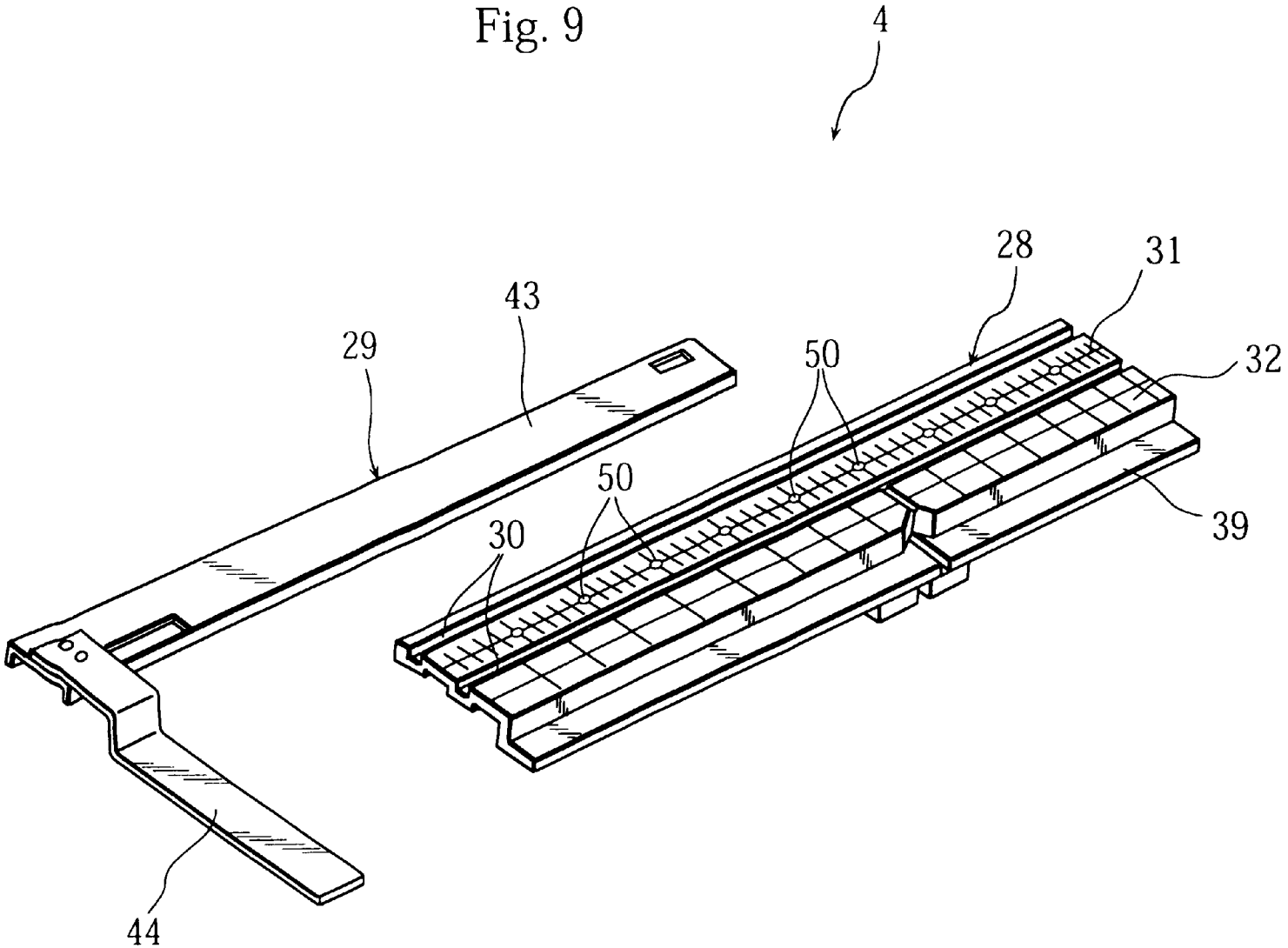
FIG. 9 is a perspective view showing another scale.

As shown in FIG. 8, the supporting rail 1 may be formed with a band plate bent into a shape of inverted T. And, as shown in FIG. 9, in the scale 4, it is preferable to dispose magnets on the sliding face of the scale main body 28 or the slide portion 43 of the sliding scale 29, and the scale main body 28 and the slide portion 43 are absorbed each other by magnetic force.

Concretely, plural magnets 50 are embedded with predetermined intervals in a direction parallel to the scale between the pair of guide grooves 30 (on the graduation 31 in inches), the slide portion 43 of the sliding scale 29 is formed with steel, and the slide portion 43 is absorbed and fixed to a desirable position by the magnetic force of the magnets 50. Therefore, fastening and loosening the wing nuts (refer to FIG. 1) are unnecessary, the sliding scale 29 can be swiftly positioned to a cutting dimension with attaching to and detaching from the scale main body 28. In this case, the slide portion 43 is slid to the scale main body 28 for fine positioning. And, the magnets may be attached to a lower face of the slide portion 43 of the sliding scale 29. In this case, the scale main body 28 is formed with steel.

Figure 10:
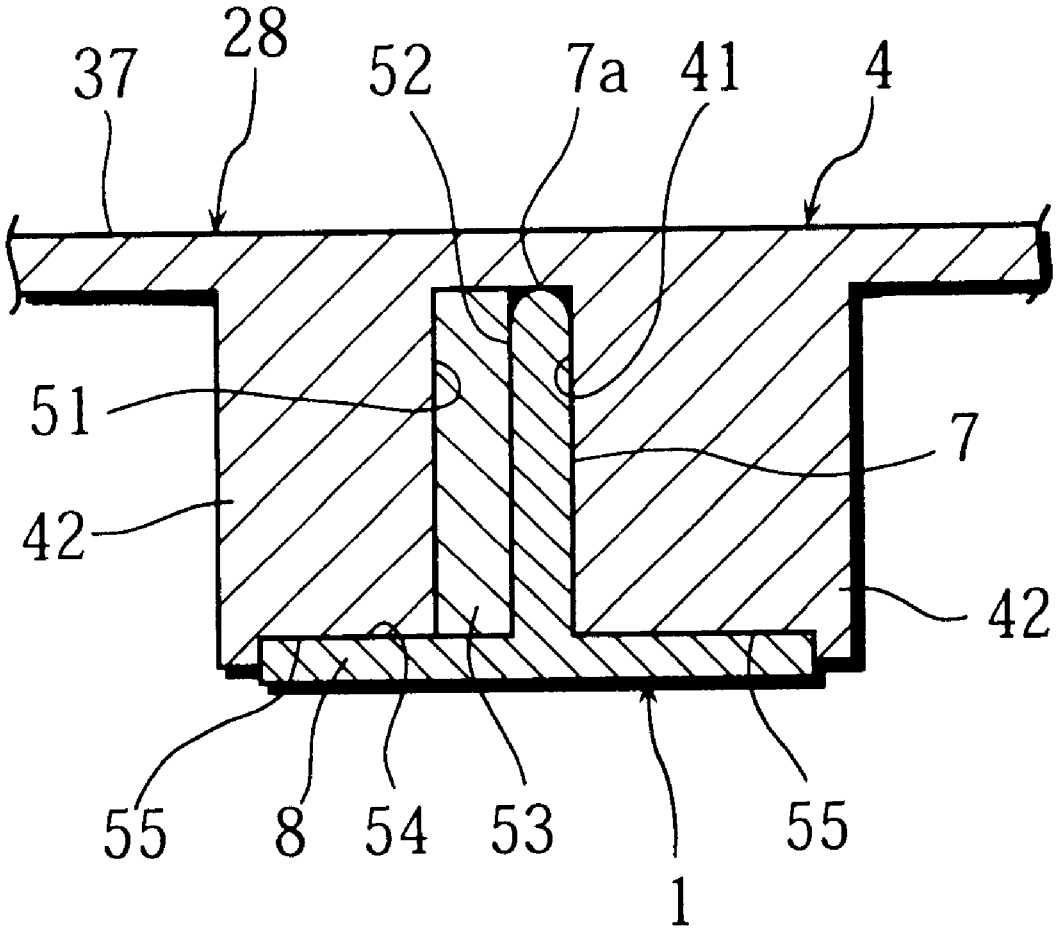
FIG. 10 is a cross-sectional view of a principal portion showing a scale fixed to a supporting rail by magnetic force.

And, as shown in FIG. 10, in the concave groove 41 opening downward formed with a pair of the sliding blocks 42 of the scale 4, it is also preferable to form a notched concave portion 51 on one of two inner faces of the concave groove 41 for fitting a magnet 53, insert the supporting ridge portion 7 of the supporting rail 1 to the above concave groove 41, and attach the scale 4 to the supporting rail 1 with magnetic force. In this case, a notched portion 55 in the back-and-forth direction is formed on a lower face of each of the sliding blocks 42 for fitting the flat board portion 8 of the supporting rail 1 as to freely slide, a lower end face of the magnet 53 contacts an upper face 54 of the flat board portion 8, and, a side face of the magnet 53 contacts a side face 52 of the supporting ridge portion 7 for fixation by magnetic force. And, it is also preferable to arrange a small gap between the side face 52 of the supporting ridge portion 7 and the magnet 53 for easy sliding of the scale 4 on the supporting rail 1. And, the magnet 53 may be fixed to a notched groove formed along the whole longitudinal length of the sliding block 42 to form one of the inner faces of the concave groove 41.

In the present invention, not restricted to the embodiments above, for example, when the operation lever 45 of the tile cutting operation unit 6 is separately formed with wood and attached to the sliding portion 49, a metal mold for the sliding portion 49 die-cast with aluminum becomes small, and production cost is reduced.

And, the front fixation post 2 and the rear fixation post 3, other than the above-described die-cast aluminum, may be die-cast or cast with other metals, cut out of metal blocks, or formed by press of galvanized sheet iron.

According to the tile cutter of the present invention, when a cutting line is formed on the tile T by the tile cutting operation unit 6 and pressing force is loaded on the both sides of the cutting line by the tile pressing leg 46, the pressing force (not resisted and dispersed by a tile supporting elastic plate as in conventional tile cutters) concentrates on the cutting line, and accurate cut on the cutting line and fine cutting faces are obtained irrespective of the thickness of the tile and without skill. That is to say, problems of cracks and chips conventionally generated on end portions of the cutting line are resolved, and defective products are prevented thereby.

And, in case that the square tile T is cut into triangles, two corners of the tile T facing each other are pinched by the notch 34 on the rear face 33 of the tile contact portion 9 of the front fixation post 2 and the notch 36 on the stepped portion 38 of the scale 4 to position and fix the tile T, a cutting line is formed accurately on the diagonal line of the tile T, and the tile T is cut into fine and accurate triangles without skill thereby.

Further, the tile cutter is simplified keeping sufficient strength for the construction in which both ends of the supporting rail 1 and the guide rail 5 formed with steel are connected and fixed to the front fixation post 2 and the rear fixation post 3 die-cast with aluminum, and the production cost is greatly reduced by decreased number of parts and great cost reduction of the metal mold for die-casting. And, operationality of the tile cutter is also improved for light weight which makes transportation and handling easy.

And, according to the tile cutter of the present invention, the tile cutter is fixed (stabilized) to stand still by stamping the footboard portion 23 when the tile cutting operation unit 6 forms a cutting line.

And, when a cutting line is formed on the tile T by the tile cutting operation unit 6, the circular cutting blade 47 is protected from damages such as nicks, crush, etc.

Further, according to the tile cutter of the present invention, the sliding scale 29 is swiftly positioned to a position of a cutting dimension by attaching to and detaching from the scale main body 28 or sliding on the scale main body 28. In other words, fastening and loosening of nuts for attachment of the sliding scale 29 to the scale main body 28 are unnecessary, and working efficiency is improved thereby. And, the tile cutter is easily stored by removing the scale 4 from the supporting rail 1 which makes the tile cutter compact.

And, the tile T is swiftly positioned and fixed by the scale 4 attached to and detached from or slid on the supporting rail 1. In other words, fastening and loosening of nuts for attachment of the scale 4 to the supporting rail 1 are unnecessary, and working efficiency is improved thereby.

While preferred embodiments of the present invention have been described in this specification, it is to be understood that the invention is illustrative and not restrictive, because various changes are possible within the spirit and indispensable features.

What is claimed is:

1. A tile cutter comprising:

a supporting rail of which cross section is inverted T having a straight supporting ridge portion in longitudinal direction;

a front fixation post, having a tile contact portion at right angles with the supporting rail, attached to an end of the supporting rail;

a rear fixation post attached to the other end of the supporting rail;

a guide rail arranged on an upper end of the front fixation post and an upper end of the rear fixation post parallel to the supporting rail;

a scale for measuring tile cutting dimension, having a tile receiving plate of which upper face corresponds to a top portion of the supporting ridge portion, attached to the supporting rail in the direction at right angles with the supporting rail as to freely slide along the supporting rail; and a tile cutting operation unit, having an operation lever on an upper portion and a tile pressing leg and a circular cutting blade on a lower portion, attached to the guide rail as to freely slide along the guide rail:

wherein a notch for tile positioning is formed at a position just above the supporting rail and on a rear face of the tile contact portion which contacts an edge of a tile, and another notch for tile positioning is formed at a position just above the supporting rail and on a stepped face portion between an upper face of the scale and the upper face of the tile receiving plate.

2. The tile cutter as set forth in claim 1, wherein the rear fixation post has a footboard portion at a lower end.

3. The tile cutter as set forth in claim 1 or claim 2, wherein a V-groove in a back-and-forth direction as a clearance for the circular cutting blade is formed at a position just above the supporting rail and on an upper face side of the tile contact portion, and another V-groove in the back-and-forth direction as a clearance for the circular cutting blade is formed at a position just above the supporting rail and on the upper face side of the scale.

4. The tile cutter as set forth in claim 1 or claim 2, wherein:

a V-groove in a back-and forth direction as a clearance for the circular cutting blade is formed at a position just above the supporting rail and on an upper face side of the tile contact portion, and another V-groove in the back-and-forth direction as a clearance for the circular cutting blade is formed at a position just above the supporting rail and on the upper face side of the scale;

the scale is provided with a scale main body detachably attached to the supporting rail at right angles with the supporting rail, and an L-shaped sliding scale having a slide portion attached to the scale main body as to freely slide along guide grooves formed in a longitudinal direction on the upper face of the scale main body; and magnets are disposed on a sliding face of the scale main body side or a sliding face of the slide portion side as the scale main body and the slide portion are absorbed each other by magnetic force.

5. The tile cutter as set forth in claim 1 or claim 2, wherein:

a V-groove in a back-and forth direction as a clearance for the circular cutting blade is formed at a position just above the supporting rail and on an upper face side of the tile contact portion, and another V-groove in the back-and-forth direction as a clearance for the circular cutting blade is formed at a position just above the supporting rail and on the upper face side of the scale;

the scale is provided with a scale main body detachably attached to the supporting rail at right angles with the supporting rail, and an L-shaped sliding scale having a slide portion attached to the scale main body as to freely slide along guide grooves formed in a longitudinal direction on the upper face of the scale main body; and a pair of sliding blocks forming a concave groove opening downward are formed on a lower face of the scale main body of the scale, a magnet is fitted to one of two inner faces of the concave groove, the supporting ridge portion of the supporting rail is inserted to the concave groove as the scale is attached to the supporting rail by magnetic force.

6. The tile cutter as set forth in claim 1 or claim 2, wherein the supporting rail and the guide rail are formed with steel, and the front fixation post and the rear fixation post are die-cast with aluminum.

* * * * *